United States Patent [19]

Neugart

[11] 4,406,678

[45] Sep. 27, 1983

[54] DUST COLLECTOR FOR VACUUM CLEANER

[75] Inventor: Horst Neugart, Wuppertal, Fed. Rep. of Germany

[73] Assignee: Vorwerk & Co Interholding GmbH, Wuppertal, Fed. Rep. of Germany

[21] Appl. No.: 346,913

[22] Filed: Feb. 8, 1982

[30] Foreign Application Priority Data

Feb. 20, 1981 [DE] Fed. Rep. of Germany ... 8104740[U]

[51] Int. Cl.[3] ..... B01D 46/02

[52] U.S. Cl. ..... 55/372; 55/473; 55/528; 15/351

[58] Field of Search ..... 55/372–377, 55/473, 482, 528; 15/351, 353

[56] References Cited

U.S. PATENT DOCUMENTS

| | | | |
|---|---|---|---|
| 1,992,042 | 2/1935 | Rurka | 55/372 |
| 1,997,720 | 4/1935 | Emmons | 55/370 |
| 2,597,927 | 5/1952 | Endres | 55/519 |
| 2,784,800 | 3/1957 | Segesman | 55/375 |
| 3,279,157 | 10/1966 | Andersson-Sason et al. | 55/410 |
| 3,550,182 | 12/1970 | Kivela | 55/DIG. 3 |

*Primary Examiner*—Bernard Nozick

*Attorney, Agent, or Firm*—Michael J. Striker

[57] ABSTRACT

A dust collector for a vacuum cleaner having a blower has an outer wall with an air-impermeable main portion bounding an inner chamber and a limited air-permeable portion, a filter accommodated in the chamber and connectable with the blower, and an additional filtering member associated with the air-permeable portion of the outer wall. The additional filtering member may be composed of an electrostatically chargeable filtering material and may be formed as a separate member or as a part of the wall of the dust collector.

4 Claims, 4 Drawing Figures

DUST COLLECTOR FOR VACUUM CLEANER

BACKGROUND OF THE INVENTION

The present invention relates to a dust collector for vacuum cleaners.

Dust collectors for vacuum cleaners connected with motor-operated blowers are known in the art. In a known dust collector, its wall is composed of an air-impermeable material and accommodates a filter which is detachably connected with a blower nipple, and the wall has an air-permeable portion in a limited region. The wall is generally composed of synthetic plastic material or synthetic leather and has slots for air exiting. When such air collector operates with very fine dust, there is a possibility that a great part of this dust passes through the filter accommodated in the wall of the dust collector and further travels outwardly through the openings. The same is true for dust collectors which are provided, instead of a rigid wall, with conventional fabric jackets. Here the dust which is not retained by the filter passes through the fabric.

SUMMARY OF THE INVENTION

Accordingly, it is an object of the present invention to provide a dust collector for a vacuum cleaner which avoids the disadvantages of the prior art.

More particularly it is an object of the present invention to provide a dust collector for a vacuum cleaner in which fine dust particles, which in normal filters are not intercepted, do not exit outwardly into the surrounding air.

In keeping with these objects, and with others which will become apparent hereinafter, one feature of the present invention resides, briefly stated, in a dust collector for a vacuum cleaner having a blower, which has an outer wall with an air-impermeable main portion bounding an inner chamber, and a limited air-permeable portion, a filter accommodated in the chamber and connectable with the blower, and an additional filtering member associated with the air-permeable portion of the outer wall.

The filtering member may be composed of an electrostatically charged filtering material. The first-mentioned filter is arranged to intercept all dust particles, whereas the filtering member of electrostatically charged filtering material is arranged to intercept fine dust particles.

When the dust collector is designed in accordance with the present invention, finest dust particles can be intercepted so that they do not escape into the surrounding air.

In accordance with another feature of the present invention, the above-mentioned filtering member of electrically charged filtering material is arranged interchangeable in the inventive dust collector.

Still another feature of the present invention is that the filtering member is furthermore formed as an additional member associated with the air-permeable portion of the wall. The thus formed separate filtering member can be accommodated in a pocket-shaped part attached to the air-permeable portion of the wall.

A further feature of the present invention is that the filtering member directly forms the air-permeable portion of the outer wall and is fixedly connected with the air-impermeable portion of the same. In this case, the filtering member may form a side portion of the outer wall of the dust collector.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
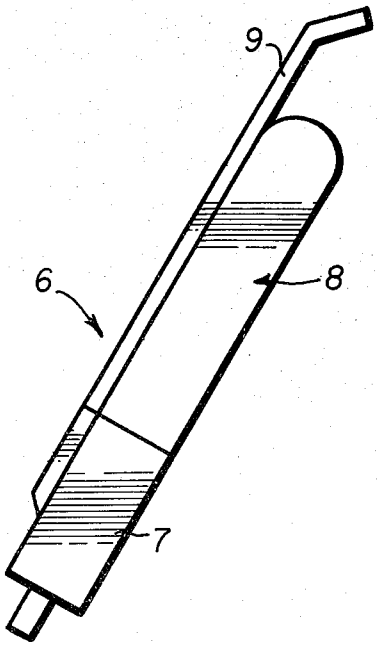
FIG. 1 is a view schematically showing a vacuum cleaner with a dust collector.

FIG. 1 shows a hand-held vacuum cleaner which is identified by reference numeral 6 and includes a motor-driven blower 7, a dust collector 8 connected with the blower 7, and a handle 9.

Figure 2:
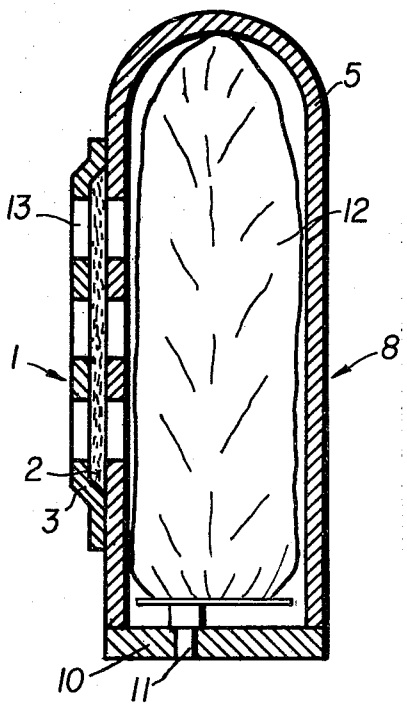
FIG. 2 is a view schematically showing a dust collector in accordance with the present invention, of the vacuum cleaner.

The dust collector 8 in accordance with the present invention is more clearly shown in FIG. 2. The dust collector 8 has an air-impermeable wall identified by reference numeral 5. One portion of this wall which is identified by reference numeral 1 is air-permeable. The wall 5 is also provided with a bottom plate 10 with an opening or nipple 11. A filter bag 12 is accommodated inside the wall 5 and connected with the nipple 11.

The air from a not shown motor-operated blower unit is supplied through the nipple 11 into the filter bag 12. The air passes through the filter bag 12 and is cleaned. Thereafter it travels through the air-permeable portion 1 in the air-impermeable wall 5 and exits outwardly through the former.

An additional filtering member, such as an electrostatically charged filtering material 2, is arranged in the region of the air-permeable portion 1 of the dust collector. Fine particles which have not been intercepted by the filter bag 12 are retained by the filtering material 2. Thereby the fine particles are collected in the dust collector and do not leave the same into the surrounding air.

As can be seen from FIG. 2, a pocket-shaped member 3 is further provideed in the region of the air-permeable portion 1 of the wall 5. The pocket-shaped member 3 is attached to the wall 5. This attachment can be carried out by any means which are known per se in the art and thereby are not shown in the drawings. The electrically charged filtering material 2 is accommodated in the pocket-shaped member 3 and thereby retained in the region of the air-permeable portion 1 of the wall 5.

Figure 3:
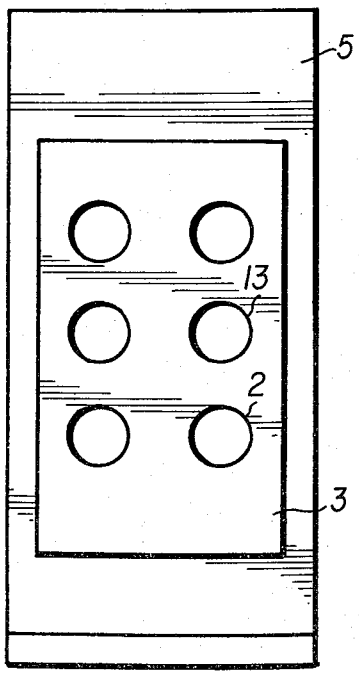
FIG. 3 is a side view of the dust collector shown in FIG. 2.

FIG. 3 shows a side view of the dust collector. The pocket-shaped member 3 is provided with openings 13 which can correspond to the openings of the air-permeable portion 1 of the wall 5. As mentioned above, the fine dust particles are intercepted by the electrostatically charged filtering material 2, whereas cleaned air freely exits through the openings 13 of the pocket-shaped part 3.

Figure 4:
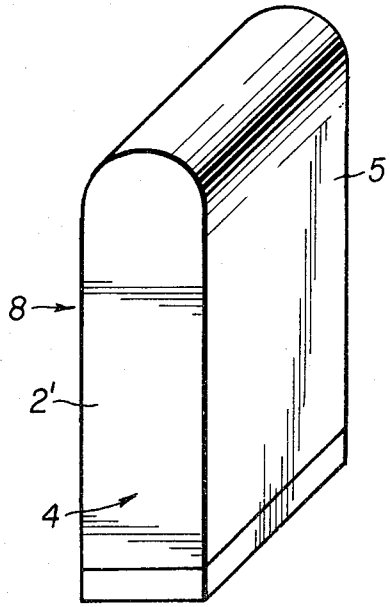
FIG. 4 is a view showing the inventive dust collector in accordance with another embodiment of the invention.

In the embodiment shown in FIGS. 2 and 3, the additional filtering member formed as electrostatically chargeable filtering material 2 is separate from the wall of the dust collector. FIG. 4 shows another embodiment of the dust collector 8. In this embodiment, the entire lateral wall 4 of the air-impermeable main wall 5 is formed as an additional filtering member, or more particularly as an additional air-permeable electrostatically charged filtering material 2'. The air-permeable electrostatically chargeable filtering material 2 can be connected with the remaining portion of the wall 5 by known means, for example by sewing, gluing, welding, or the like.

It will be understood that each of the elements described above, or two or more together, may also find a useful application in other types of constructions differing from the types described above.

While the invention has been illustrated and described as embodied in a dust collector for vacuum cleaners, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A dust collector for a vacuum cleaner with a blower, comprising a housing bounding an inner chamber and having an inlet, a main air-impermeable wall, and a limited air-permeable wall forming an outlet;

a filter bag having an inlet and accommodated in said inner chamber of said housing and connectable with the blower via said inlets; and an additional filtering member capable of retaining fine dust particles forming said air permeable wall which defines said outlet and connected with said air-impermeable wall.

2. A dust collector defined in claim 1, wherein said air-permeable wall formed by said filtering member is a side wall of said housing.

3. A dust collector as defined in claim 1, wherein said filter bag is arranged to intercept relatively coarse dust particles, said filtering member being arranged to intercept fine dust particles.

4. A dust collector as defined in claim 1, wherein said filtering member is composed of an electrostatically charged filtering material.

* * * * *